US005092995A

United States Patent [19]

Gerteis

[11] Patent Number: 5,092,995

[45] Date of Patent: Mar. 3, 1992

[54] INVERTIBLE FILTER CENTRIFUGE WITH A FILLER PIPE CONNECTABLE TO A PRESSURIZATION OR DEPRESSURIZATION SOURCE

[75] Inventor: Hans Gerteis, Bietigheim-Bissingen, Fed. Rep. of Germany

[73] Assignee: Heinkel Industriezentrifugen GmbH & Co., Bietigheim-Bissingen, Fed. Rep. of Germany

[21] Appl. No.: 466,332

[22] PCT Filed: Nov. 24, 1988

[86] PCT No.: PCT/EP88/01067

§ 371 Date: May 9, 1990

§ 102(e) Date: May 9, 1990

[87] PCT Pub. No.: WO89/05193

PCT Pub. Date: Jun. 15, 1989

[30] Foreign Application Priority Data

Nov. 28, 1987 [DE] Fed. Rep. of Germany ..... 3740411

[51] Int. Cl.[5] ..... B01D 33/067

[52] U.S. Cl. ..... 210/232; 210/373; 210/380.3; 210/416.1; 494/23; 494/25; 494/26; 494/38; 494/41; 494/83

[58] Field of Search ..... 210/232, 236, 370, 380.1, 210/365, 367, 781, 408, 380.3, 373, 416.1; 494/41, 83, 38, 26, 39, 40, 23, 25

[56] References Cited

U.S. PATENT DOCUMENTS

| | | | |
|---|---|---|---|
| 3,623,613 | 11/1971 | Quetsch | 210/370 |
| 3,885,734 | 5/1975 | Lee | 494/25 |
| 4,193,874 | 3/1980 | Gerteis | 210/370 |
| 4,269,711 | 5/1981 | Gerteis | 210/380.3 |
| 4,300,717 | 11/1981 | Latham, Jr. | 494/41 |
| 4,502,699 | 3/1985 | Mukerji | 494/41 |
| 4,589,865 | 5/1986 | Gullers | 494/26 |
| 4,702,831 | 10/1987 | Gerteis | 210/408 |
| 4,808,308 | 2/1989 | Flory | 210/370 |
| 4,915,851 | 4/1990 | Flory | 210/781 |
| 5,004,540 | 4/1991 | Hendricks | 210/370 |

FOREIGN PATENT DOCUMENTS

| | | |
|---|---|---|
| 0069449 | 12/1983 | European Pat. Off. . |
| 3430507 | 2/1986 | Fed. Rep. of Germany . |

*Primary Examiner*—W. Gary Jones
*Assistant Examiner*—Sun Uk Kim
*Attorney, Agent, or Firm*—Kramer, Brufsky & Cifelli

[57] ABSTRACT

An invertible filter centrifuge is provided comprising a rotary drum which is mounted in a cantilever manner in a housing and has radial passages for filtrate, a lid which is axially displaceable relative to the drum and closes the free front side of the latter, a filler opening on the lid for suspension to be filtered, and filler pipe which, on the one hand, is secured to the housing and, on the other hand, penetrates the filler opening, the outlet end of the filler pipe being located inside the drum during the centrifuging operation, characterized in that for varying the pressure in the drum (16), the filler pipe (26) is connectable to a pressurization or depressurization source (44) and is sealed by a combined rotary and sliding seal (45, 46, 47, 53) on said lid (25).

11 Claims, 5 Drawing Sheets

Figure 1:
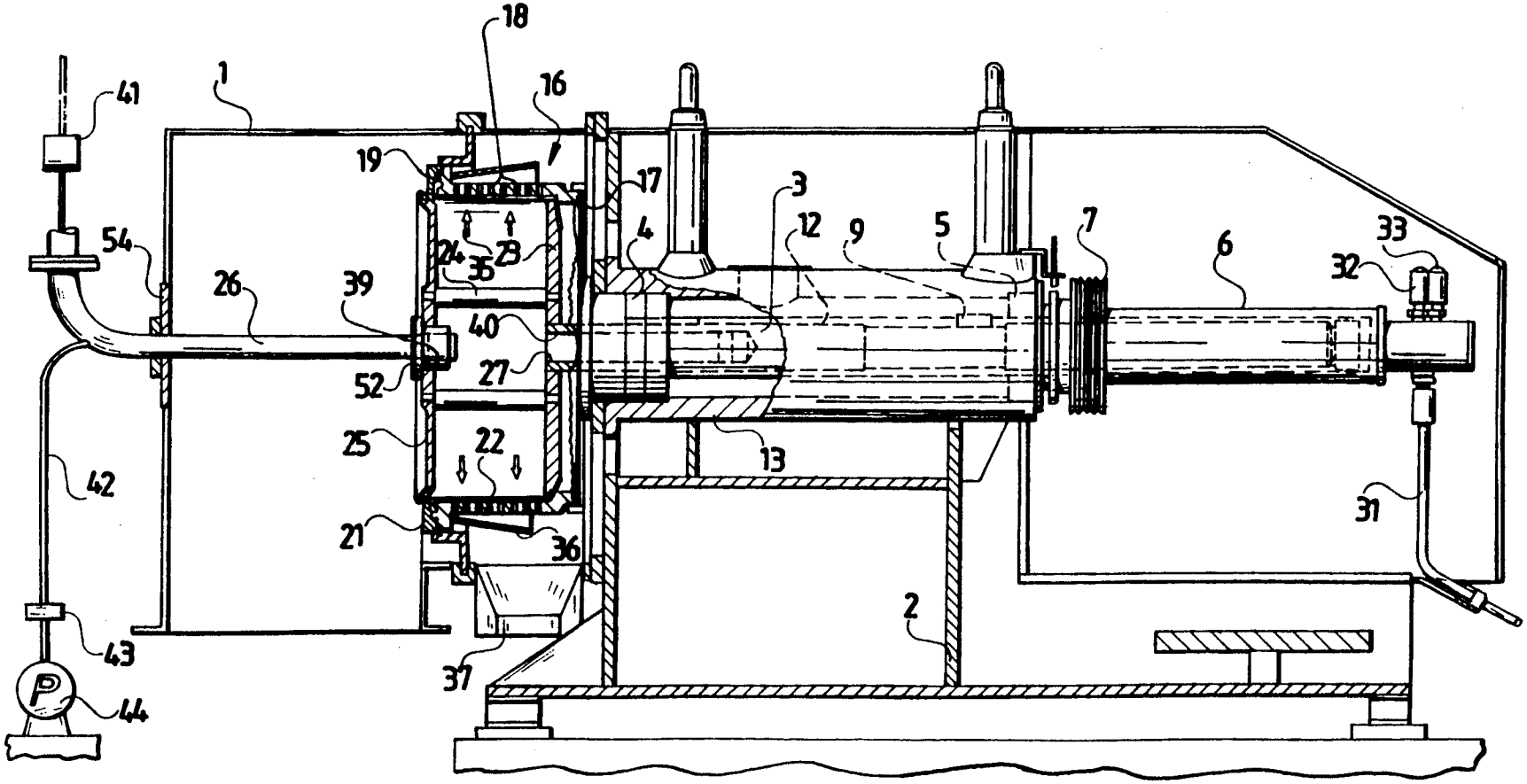

61
58
59
45
26
27
12
40
46
47
48
49
51
52
53
54
55
56
39
16
1
62
63
64

INVERTIBLE FILTER CENTRIFUGE WITH A FILLER PIPE CONNECTABLE TO A PRESSURIZATION OR DEPRESSURIZATION SOURCE

The invention relates to an invertible filter centrifuge comprising a rotary drum which is mounted in a cantilever manner in a housing and has radial passages for filtrate, a lid which is axially displaceable relative to the drum and closes the free front side of the latter, a filler opening on the lid for suspension to be filtered, and a filler pipe which, on the one hand, is secured to the housing and, on the other hand, penetrates the filler opening, the outlet end of the filler pipe being located inside the drum during the centrifuging operation.

An invertible filter centrifuge of this kind used to separate solid and liquid components in a suspension is described in German patent 2 710 624. It is also known to provide on the filler opening of the lid a spray protection means which cooperates with the outlet end of the filler pipe (German published patent application 3 430 507).

In filter centrifuges, it is sometimes advantageous to subject the drum to a gas under excess pressure (for example, hot vapor) to increase the hydraulic pressure occurring in the centrifugal force field or to blow through the filter cake in order to dry it or to subject it to vapor washing. Alternatively, one may also want to subject the drum to negative pressure.

Such a pressure variation in the interior of the drum is not possible in a generic invertible filter centrifuge because the filler pipe penetrating the filler opening thereof is not sealed in a pressure-tight manner.

The object of the invention is to so improve a generic invertible filter centrifuge that the centrifugal chamber enclosed by the drum can be subjected to excess or negative pressure.

The object is accomplished in accordance with the invention in that in order to vary the pressure in the drum, the filler pipe is connectable to a pressurization or depressurization source and is sealed by a combined rotary and sliding seal on the lid.

In a preferred embodiment of the invention, provision is made for the filler pipe to be supported on the housing in an elastic bearing which in combination with the rotary and sliding seal permits additional wobble movements of the filler pipe.

Three things are achieved with this design: The filler pipe is simultaneously used as feed pipe for pressure gas (vapor) or for generating a negative pressure by pumping-off so separate pipes can be dispensed with for this purpose. The combined rotary and sliding seal between filler pipe and lid prevents the pressurized gas from escaping from the centrifugal chamber or gas (atmospheric air) from entering the centrifugal chamber from the ambient. The elastic supporting of the filler pipe on the housing compensates wobble movements of the drum resulting from imbalance and so perfect sealing is ensured by the combined rotary and sliding seal during operation. The sliding displacement of the lid relative to the filler pipe is not thereby impaired.

Figure 2:
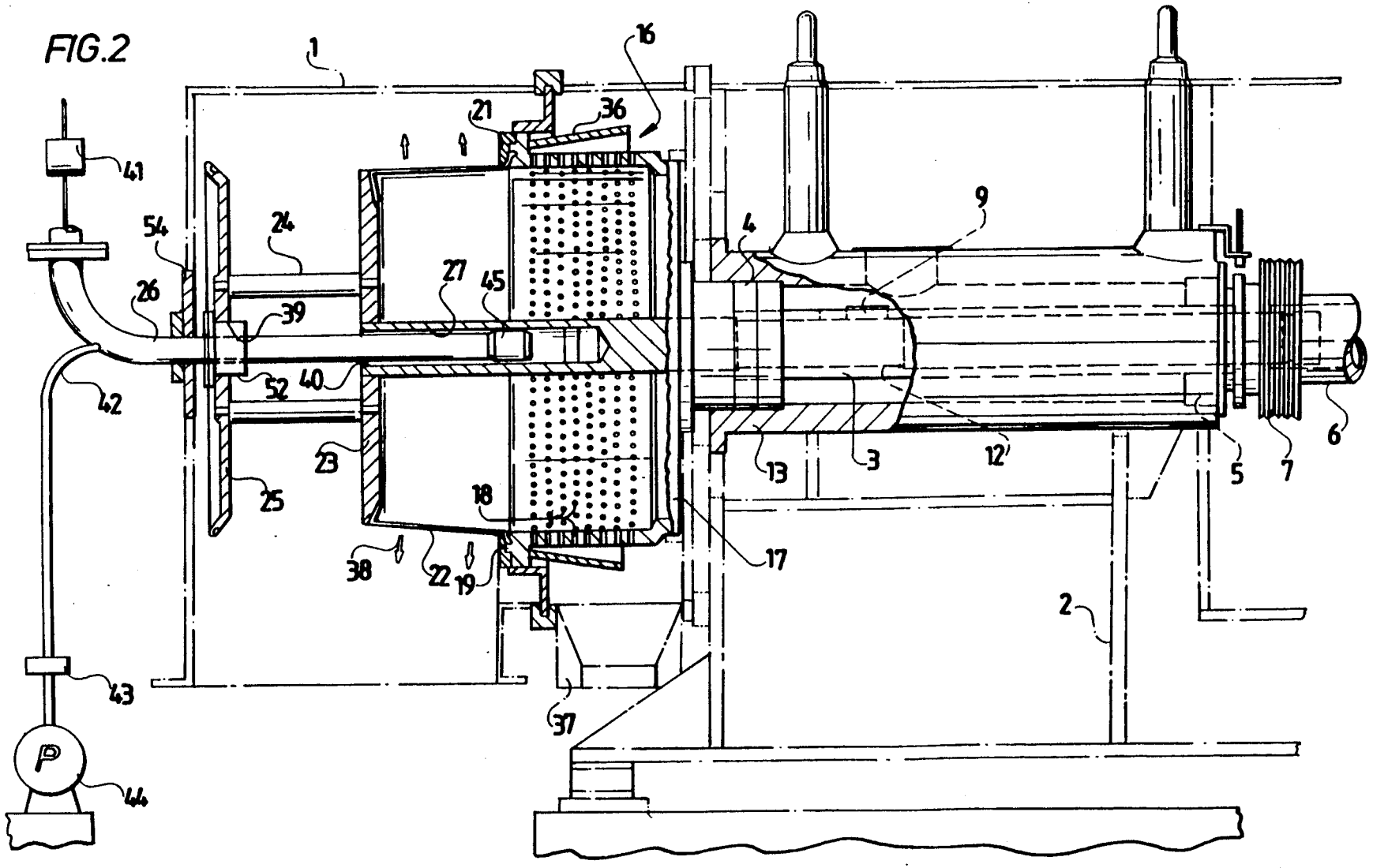
Figure 3:
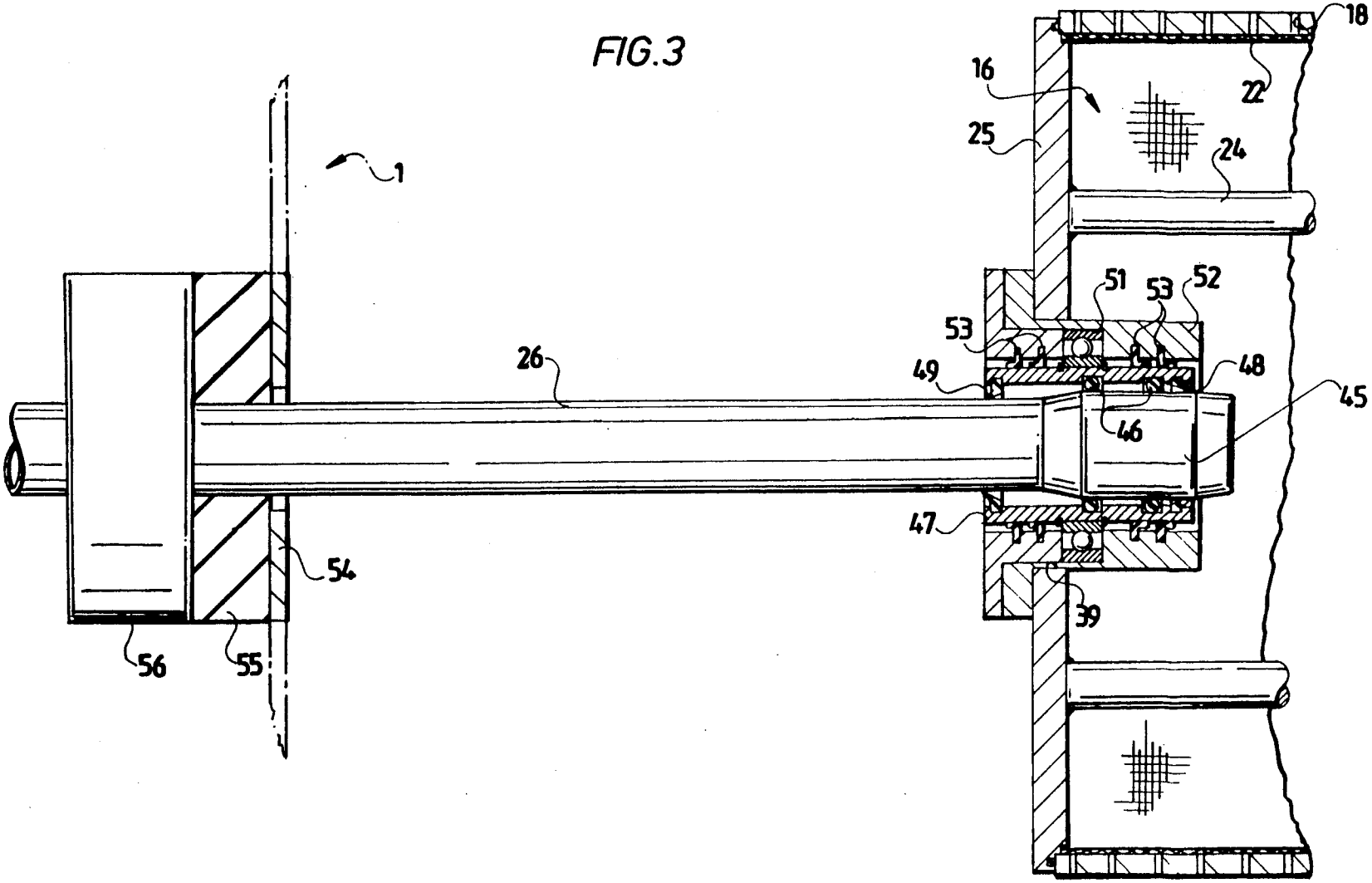
Figure 4:
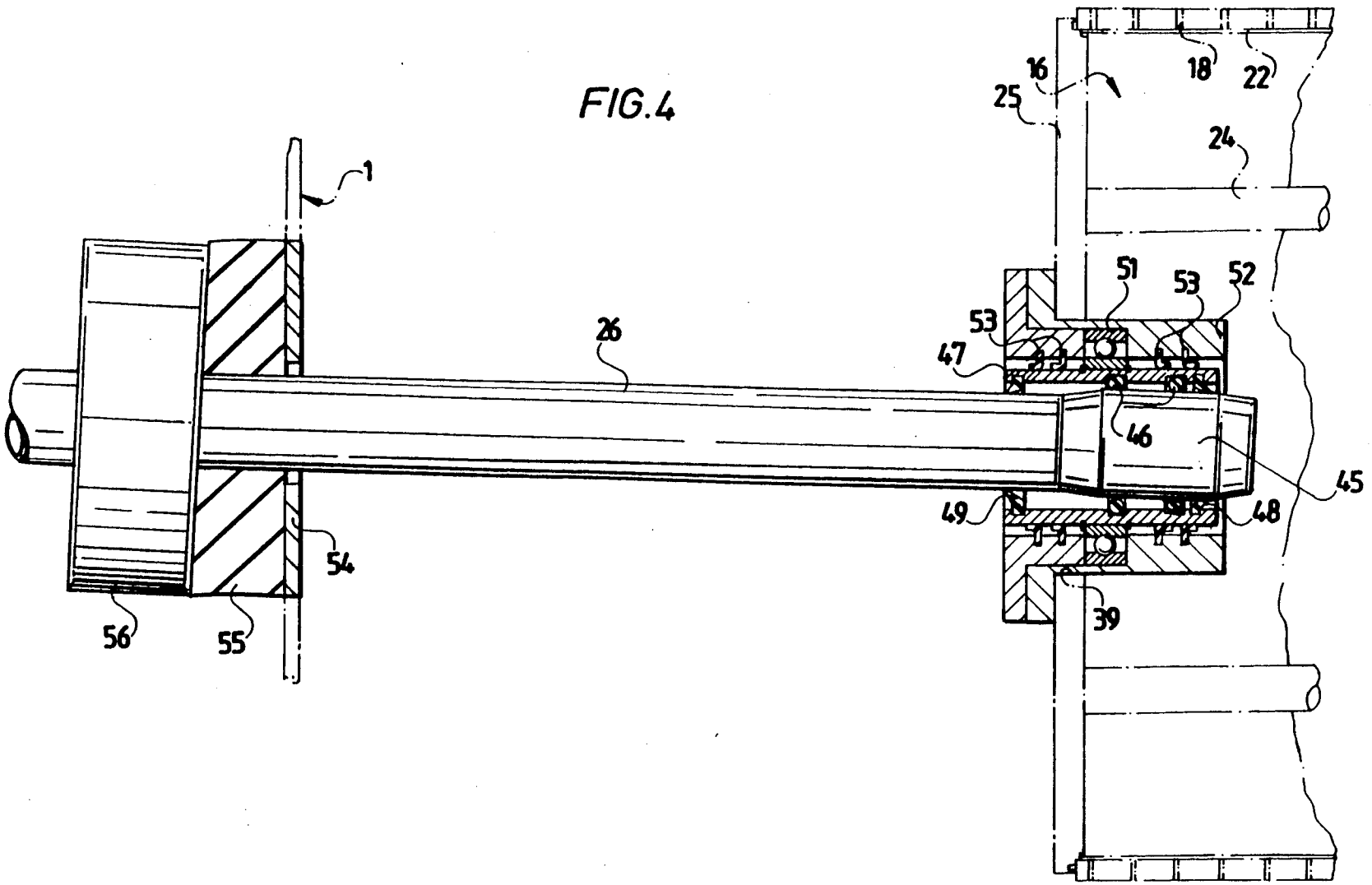
Figures 5, 6:
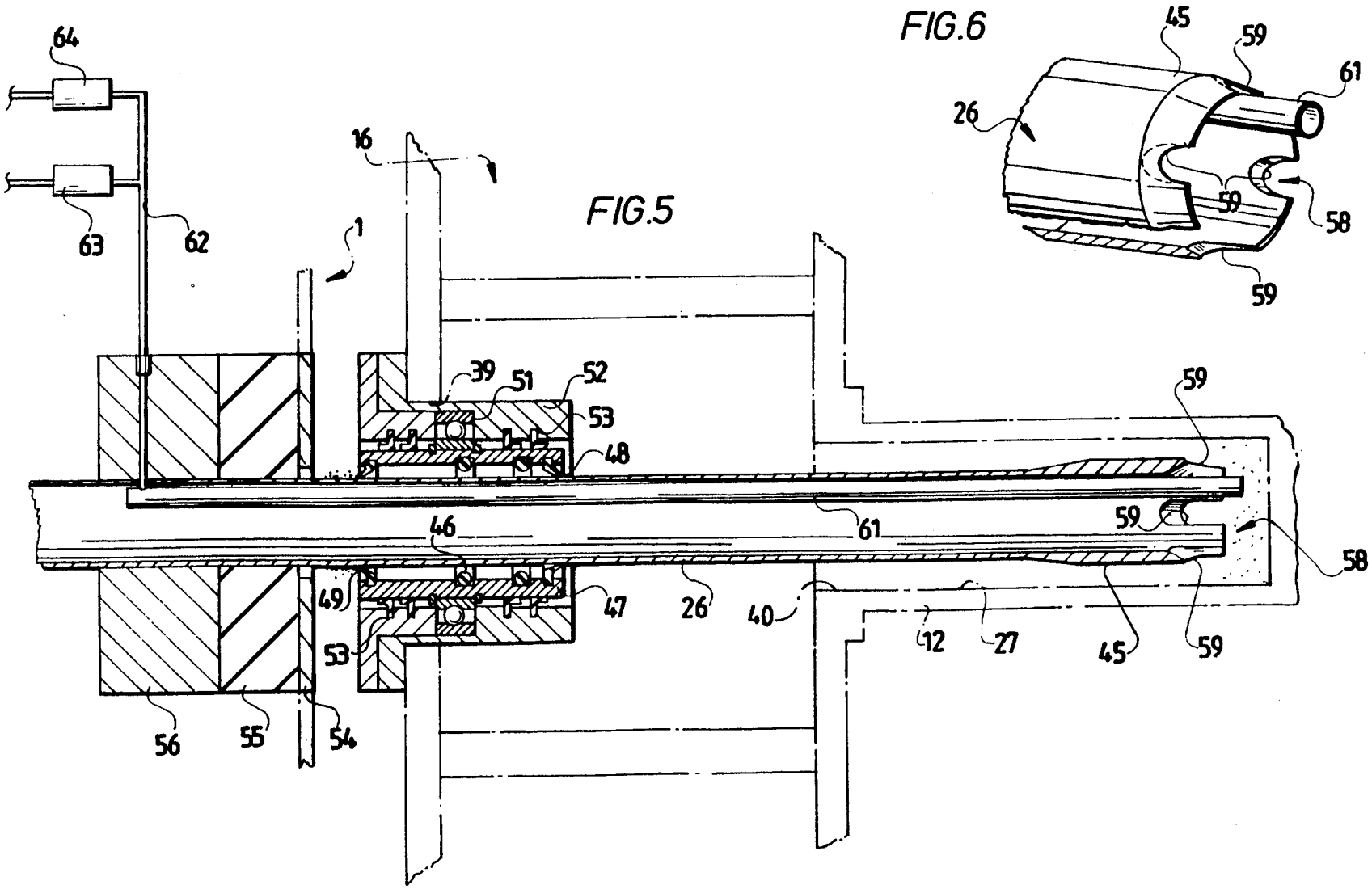

The following description of preferred embodiments serves in conjunction with the appended drawings to explain the invention in further detail. The drawings show:

FIG. 1 a schematic sectional view of an invertible filter centrifuge in the work phase of the centrifuging;

FIG. 2 schematically the centrifuge of FIG. 1 in the work phase of throwing off the solids;

FIG. 3 an enlarged view of a rotary and sliding seal between filler pipe and centrifugal chamber of the centrifuge;

FIG. 4 the rotary and sliding seal of FIG. 3 during wobble movement of the filler pipe;

FIG. 5 a modified embodiment of the filler pipe with ventilating pipe; and

FIG. 6 a perspective detail view of the filler pipe end.

The invertible filter centrifuge shown in FIG. 1 comprises a schematically illustrated housing 1 sealingly enclosing the entire machine. A hollow shaft 3 is mounted for rotation in bearings 4, 5, on a stationary machine frame 2 in the housing 1. A pressure medium cylinder 6 is flanged in a sealed manner on the end of the hollow shaft 3 protruding beyond the bearing 5 on the right in FIGS. 1 and 2. A drive wheel 7 is rotationally fixedly connected to the cylinder 6. Via the drive wheel 7, the cylinder 6 and hence the hollow shaft 3 can be made to rotate rapidly by, for example, a V-belt of an electric motor (not illustrated).

The hollow shaft 3 extending rigidly between the bearings 4, 5 comprises an axially oriented wedge-shaped groove (not illustrated) in which a wedge-shaped piece 9 is axially displaceable. This wedge-shaped piece 9 is rigidly connected to a shaft 12 displaceable inside the hollow shaft 3. The shaft 12, therefore, rotates jointly with the hollow shaft 3, but is axially displaceable in the latter.

The shafts 3 and 12 extend in a bushing-shaped housing 13 which also serves to hold the bearings 4, 5 and is supported on the machine frame 2.

A pot-shaped centrifugal drum 16 is flanged with its bottom 17 in a rotationally fixed manner on the end of the hollow shaft 3 protruding beyond the bearing 4 on the left in FIGS. 1 and 2. The drum 16 has radially extending openings 18 on its cylindrical side wall. On its front side opposite the bottom 17, the drum 16 is open. On the flange-like opening rim 19 surrounding this open front side, the one rim of a substantially cylindrical filter cloth 22 is sealingly clamped by a holding ring 21. The other rim of the filter cloth 22 is sealing-ly joined in an appropriate manner to a bottom piece 23 which is rigidly connected to the displaceable shaft 12 freely penetrating the bottom 17.

A centrifugal chamber lid 25 is rigidly attached to the bottom piece 23 via stay bolts 24, thereby leaving a space therebetween. In FIG. 1, the centrifugal chamber lid 25 seals the centrifugal chamber of the drum 16 by resting on its opening rim and in FIG. 2 is lifted freely off the drum together with the bottom piece 23 by the shaft 12 being pushed axially out of the hollow shaft 3.

A filler pipe 26 is arranged on the front side of the invertible filter centrifuge on the left in FIGS. 1 and 2 for introducing into the centrifugal chamber of the drum 16 (FIG. 1) a suspension which is to be broken down into its solid and liquid components. In the operating state shown in FIG. 2, the filler pipe 26 extends into a bore 27 of the displaceable shaft 12.

Pipes 31 and valves 32, 33 cooperating with the pressure medium cylinder 6 serve to reciprocate the displaceable shaft 12 carrying the drum 16.

In operation, the invertible filter centrifuge first assumes the position shown in FIG. 1. The displaceable shaft 12 is retracted into the hollow shaft 3 and the pressure medium cylinder 6, whereby the bottom piece 23 connected to the shaft 12 is located in the proximity of the bottom 17 of the centrifugal drum 16 and the filter cloth 22 is turned into the drum such that it lies in the interior of the latter. The centrifugal chamber lid 25 rests sealingly on the opening rim of the drum 16. As the drum rotates, suspension to be filtered is introduced through the filler pipe 26. The liquid components of the suspension pass in the direction of arrows 35 through the openings 18 of the drum and are directed by an impact plate 36 into a discharge pipe 37. The solid particles of the suspension are held back by the filter cloth 22.

As the centrifugal drum 16 continues to rotate, the shaft 12 is now displaced in accordance with FIG. 2 (to the left), whereby the filter cloth 22 turns inside out and the solid particles adhering to it are whirled outwards in the direction of arrows 38 into the housing 1. From there they can be easily conveyed away. In the position shown in FIG. 2, the filler pipe 26 has entered the bore 27 of the shaft 12 through openings 39, 40 provided in the lid 25 and the bottom piece 23, respectively. After termination of the throwing-off of the solid particles under the influence of the centrifugal force, the filter centrifuge is returned to the operating position according to FIG. 1 by the shaft 12 being pushed back, whereby the filter cloth 22 turns back in the opposite direction. In this way, operation of the centrifuge with a constantly rotating centrifugal drum 16 is possible.

As shown schematically in FIG. 1, the filler pipe 26 contains a valve 41 which interrupts the supply of suspension and seals the filling pipe off from a storage tank containing the suspension. Via a pipe 42 with a shut-off valve 43 opening into the filler pipe 26, a gas, in particular compressed air, can be introduced by a pump 44 into the filler pipe 26 and hence into the centrifugal chamber of the drum 16. The inside pressure thereby created in the drum 16 increases the hydraulic pressure occurring in the field of centrifugal force of the rotating drum and thereby has an overall favorable effect on the filtration results.

In another embodiment, it is also possible to introduce hot water vapor under pressure into the drum through the pipe 42 and to thereby subject the filter cake adhering to the filter cloth 22 to steam washing.

In yet another embodiment, the pipe 42 may be dispensed with. The suspension is then introduced directly under pressure into the filler pipe 26 and the drum 16 by, for example, a pump. In certain cases, this pressure may be the hydrostatic pressure which is generated in the filler pipe 26 by a suspension supply tank arranged at an appropriately high level and connected with the filler pipe 26.

In a further embodiment of the invention, it is also possible to generate a negative pressure instead of an excess pressure in the drum 16 by, for example, the pump 44 in FIG. 1 being designed as an aspiration pump. Such a negative pressure introduced periodically may, for example, have a favorable effect on the releasing of the filter cake from the filter cloth 22.

If an excess or negative pressure exists in the drum 16, a pressure-tight seal must be provided between the stationary filler pipe 26 and the rotating lid 25 of the drum 16. This will be explained in further detail with reference to FIGS. 3 and 4.

The filler pipe 26 comprises at its front free end a thicker section 45 terminating conically on either side thereof and of otherwise circular-cylindrical shape. In the operating state shown in FIG. 1, i.e., during filtration with excess or negative pressure in the centrifugal chamber, elastic sealing rings 46 lie against the thicker section 45, thereby producing a pressure-tight seal. The sealing rings 46, for their part, are inserted in corresponding grooves of a sleeve 47 which, together with the filler pipe 26, is held stationarily. Arranged on the inside wall of the sleeve 47 are an elastic guide ring 48 and an elastic, annular wiper 49. In the operating state shown in FIG. 3, the guide ring 48 engages the thicker section 25 and the wiper 49 engages the circular-cylindrical outer wall of the filler pipe 26. The sleeve 47 is mounted by a rotary bearing 51, indicated only schematically, for rotation in a bushing 52 which is fixedly connected to the lid 25 of the drum 16. Several radial shaft sealing rings 53 are arranged between the (stationarily held) sleeve 47 and the (rotating) bushing 52.

When the (rotating) lid 25 is displaced (to the left in FIG. 3) relative to the (stationary) filler pipe 26, the sealing rings 26 slide off the thicker section 45 and move into the thinner section of the filler pipe 26 where they no longer carry out a sealing function and enclose the filler pipe 26 in spaced relation thereto (cf. FIG. 5). Hence the effect of the thicker section 45 is that the elastic sealing rings 46 are not subjected to any sliding friction over the major part of the displacement motion of the lid 25, which might result in damage to or destruction of these rings, more particularly because the outer wall of the filler pipe 26 is often covered with a thin layer of solid particles.

During displacement of the lid 25 (to the left in FIG. 3), the annular wiper 49, equipped for this purpose with a sharp, free annular edge, engages the outer wall of the filler pipe 26 and wipes off solid particles adhering thereto so the latter then no longer reach the sealing rings 26. When the lid 25 is pushed back (to the right in FIG. 3), the guide ring 48 centers the sleeve 47 and hence the sliding seals 46 relative to the thicker section 45, thereby preventing the sealing rings from becoming squashed and damaged.

In this way, the above-described sealing assembly provides a combined rotary and sliding seal which makes the centrifugal chamber pressure-tight during the filtering operation and subsequently enables displacement of the lid 25 relative to the filler pipe 26.

The cantilever drum 16 often makes wobble movements during rotation which are transmitted to the free end (thicker section 45) of the filler pipe 26. To absorb these wobble movements and prevent damage to the filler pipe 26, held stationarily as such, the latter is elastically secured to the front wall 54 of the housing 1, more specifically by an elastic, annular element 55 which encloses the filler pipe 26 and is arranged between the front wall 54 and a flange 56 fixedly connected to the filler pipe 26. The elastic element 55 is connected in some purposeful way, for example, adhesively, on the one hand, to the front wall 54 and, on the other hand, to the flange 56. Hence the thicker section 45 at the front end of the filler pipe 26 can readily follow wobble movements of the drum 16.

FIG. 4 shows a downwardly directed deflection of the filler pipe 26 during such a wobble movement when the elastic element 55 and the elastic sealing rings 46 as well as the guide ring 48 and the wiper 49 undergo corresponding deformation.

As shown in FIGS. 5 and 6, the free end of the thicker section 45 is designed as a scraper 58. For this purpose, the free front edge of the thicker section is sharpened to form an annular cutter and provided with, for example, four axially extending slots 59. When solid particles have collected in the bore 27 of the shaft 12 during the filtering, which might impede introduction of the filler pipe 26, these are scraped off by the cutter-shaped front edge of the thicker section 45 so they can enter the interior of the filler pipe 26 via the slots 59. From there they are flushed out easily when suspension is fed again.

As further shown in FIGS. 5 and 6, there is provided in the interior of the filler pipe 26 a ventilating channel 61, for example, in the form of a pipe which protrudes slightly at the free front edge of the filler pipe 26 and is connected at the opposite end to a pipe 62. At the front edge of the filler pipe 26,. the ventilating channel is open, at its opposite end closed. The pipe 62 contains a valve 63 which provides the pipe 62 with an opening into the atmosphere. Hence the interior of the drum 16 can be connected to the atmosphere for air-release and air-intake, respectively.

It is also possible to connect the pipe 62 via a further valve 64 to a pressurization or depressurization source so the channel 61 may also be used to generate an excess or negative pressure in the centrifugal drum 16.

The above-described combined rotary and sliding seal 45, 46, 47, 53 may also be used without the drum being subjected to pressure (via the filler pipe 26), for example, when for other reasons, a sealing between drum and filler pipe 26 without a gap therebetween is desired in the operating state shown in FIG. 1.

I claim:

1. An invertible filter centrifuge comprising a rotary drum mounted in a cantilevered manner in a housing and having radial passages for filtrate, a lid which is axially displaceable relative to said drum and adapted to close the free front side of said drum, a filler opening on said lid adapted to receive a suspension to be filtered, and a filler pipe which is secured to said hosing and penetrates said filler opening, the outlet end of said filler pipe being located inside said drum during the centrifuging operation, said filler pipe being connected to a pressurization or depressurization source and sealed by a combined rotary and sliding seal on said lid.

2. Centrifuge as defined in claim 1 wherein said filler pipe is supported on said housing in an elastic bearing which in combination with said rotary and sliding seal permits additional wobble movements of said filler pipe.

3. Centrifuge as defined in claim 2 wherein said filler pipe is secured on said housing by a flange with an elastic element therebetween.

4. Centrifuge as defined in claim 1 wherein said rotary and sliding seal comprises elastic sealing rings which enclose said filler pipe.

5. Centrifuge as defined in claim 1 wherein said rotary and sliding seal comprises elastic wipers which engage said filler pipe.

6. Centrifuge as defined in claim 1 wherein said rotary and sliding seal comprises a sleeve which si equipped with sealing rings and/or wiper rings and which is mounted for rotation in a bushing which is fixedly connected to said lid.

7. Centrifuge as defined in claim 6 wherein said sleeve is sealed relative to said bushing by radial shaft sealing rings.

8. Centrifuge as defined in claim 1 wherein the outlet end of said filler pipe comprises a thicker section which terminates conically on either side thereof.

9. Centrifuge as defined in claim 8 wherein the free front edge of said thicker section is adapted to function as a scraper.

10. Centrifuge as defined in claim 1 wherein said filler pipe contains a ventilating channel.

11. Centrifuge as defined in claim 10 wherein said ventilating channel is adapted to be connected to a pressurization or depressurization sources.

* * * * *